United States Patent [19]

Smith

[11] Patent Number: 4,701,090

[45] Date of Patent: Oct. 20, 1987

[54] METHOD OF MANUFACTURE OF A CAN END WITH A PUSH IN VENT TAB AND MAIN TAB

[75] Inventor: Edgar D. Smith, Ada, Mich.

[73] Assignee: Jerone Technologies, Inc., Minneapolis, Minn.

[21] Appl. No.: 862,097

[22] Filed: May 12, 1986

[51] Int. Cl.[4] ..... B21D 51/44

[52] U.S. Cl. ..... 413/13; 413/12; 413/15; 413/17; 413/20

[58] Field of Search ..... 413/12, 14, 15, 16, 413/17, 62, 67, 19, 20, 61; 220/268, 271

[56] References Cited

U.S. PATENT DOCUMENTS

| | | | |
|---|---|---|---|
| 3,334,775 | 8/1967 | Klien et al. | 220/48 |
| 3,794,206 | 2/1974 | De Line | 220/27 |
| 3,886,881 | 5/1975 | Pearce | 113/121 C |
| 3,958,717 | 5/1976 | Ellis | 220/334 |
| 4,018,178 | 4/1977 | Kline et al. | 113/121 C |
| 4,127,213 | 11/1978 | McConnellogue | 220/268 |
| 4,129,085 | 12/1978 | Klein | 413/14 |
| 4,186,678 | 2/1980 | McConnellogue | 113/121 C |
| 4,305,523 | 12/1981 | Dalli et al. | 220/268 |

*Primary Examiner*—Frederick R. Schmidt
*Assistant Examiner*—Robert Showalter
*Attorney, Agent, or Firm*—Steven E. Kahm

[57] ABSTRACT

A method of manufacturing can ends having a push down vent tab and a push down main tab, with recessed score lines under a double folded ridge of metal, where part of the score lines are broken to facilitate opening the cans. The method of manufacture uses six stations to make the can ends. One station to bubble the surface of the can end. One station to reform the bubble into a side wall and a flat bottom having a raised vent button and a raised tab button. One station for scoring the vent score line and forming the bend ridge. One station for scoring the main score around the main tab. One station for folding the side walls. And one station for depressing the area around the folded side walls and for stenciling the top of the can end. The last step in the manufacture of the can end is to spray a sealant material on the bottom of the can end.

12 Claims, 15 Drawing Figures

METHOD OF MANUFACTURE OF A CAN END WITH A PUSH IN VENT TAB AND MAIN TAB

BACKGROUND OF THE INVENTION

The most popular can ends in use today on beer and pop cans have a lift tab to provide leverage for pushing in a gate to open the cans.

Another popular can end features a pull ring attached to a tab. By pulling on the ring the tab is removed from the can . This has caused a litter problem since many people discard the pull ring tabs improperly.

Attaching a lift tab or a pull ring to a can end is wasteful in that it requires the use of more metal, more tooling , more work stations and costs more than can end designs where the user pushes in a tab with his finger.

Since there were over 68 billion can ends made in The United States in 1985, even small improvements in designs and methods of manufacture can have a significant impact in the industry.

Applicant has new design for can ends and a new method of making can ends without the use of lift tabs or pull rings. The new method requires fewer work stations, less metal and less tooling to manufacture than other can ends, resulting in cost savings to the manufacturer. Society today is conscious of diminishing natural resources and problems with garbage disposal. Therefore recycling of cans is increasingly important.

Most can ends today are made of aluminum as are the cans themselves. It is anticipated that plastic cans with metal lids will become a popular alternative to aluminum or steel cans in the near future.

Applicant proposes to use steel can ends on aluminum or plastic cans. This allows the cans to be separated from garbage magnetically whereas plastic and aluminum cans without steel can ends cannot be so easily reclaimed.

SUMMARY OF THE INVENTION

The invention eliminates the need for lift tabs and pull rings on cans. Most cans use these leveraging aids to help overcome the pressure inside the can and to help break the score line around the tabs. The present invention is opened by finger pressure pushing down first on a vent tab and then on a main tab. The vent tab releases the pressure inside the can allowing the main tab to be depressed easily Since no lift tabs or pull rings are used, less metal is consumed in the manufacture of the can ends. Another advantage is that there are fewer work stations and less tooling required when the lift tabs and pull rings are eliminated. Thus the new design will result in cheaper can ends.

It is an object of the invention to help eliminate litter since there are no lift tabs which may come off the can or pull rings which can be discarded.

It is a further object of the invention to provide steel can ends that will aid in recycling garbage since steel can be easily separated from garbage by using magnets.

It is a further object of the invention to recess the score line of the tabs under a lip of folded metal to provide a safe can so the user will not cut his finger while depressing the vent tab or the main tab, and will not cut his tongue will drinking from the can.

In the past cans with vent tabs and main tabs have been introduced to the market but have met with only limited success. The present invention discloses several improvements in design to make the can end easier for the consumer to use and cheaper for the manufacturer to make. The principle improvements are how the aperture is scored for ease of opening, the area that is opened and the process used to make the can ends which involves only 6 work stations.

DETAILED DESCRIPTION

Figure 1:
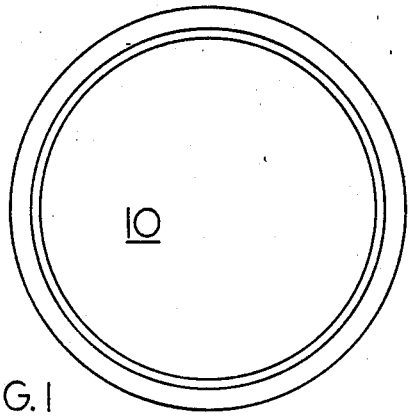
FIG. 1 shows a top view of a blank can end.
Figure 2:
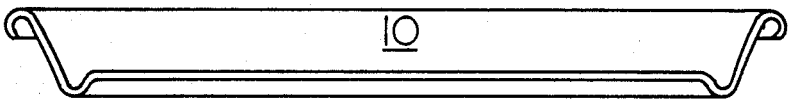
FIG. 2 shows a side view a blank can end.

FIGS. 1 and 2 show a blank can end 10 , before it begins processing into a finished can end. At this point the surface is flat and the edges are curved for later attachment to the cans.

Figure 3:
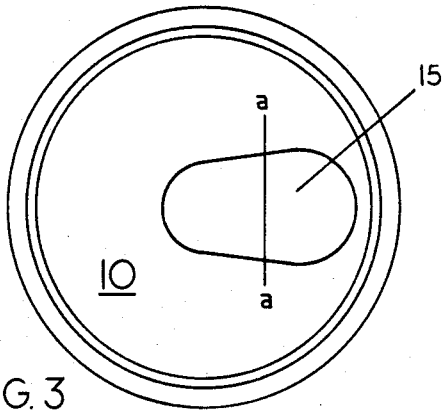
FIG. 3 a top view of the can end with the aperture bubble formed.
Figure 4:
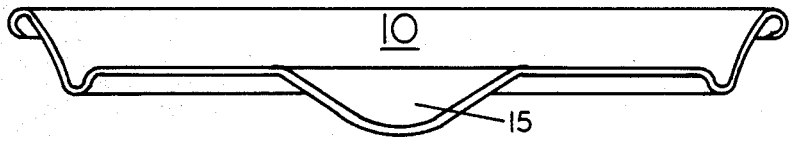
FIG. 4 shows a side view of the can end with the aperture bubble formed.

FIGS. 3 and 4 show the first step in processing the can ends. The blank is placed in a die which indents the metal forming a bubble 15. This bubble will be worked into the aperture for the can.

FIG. 3 shows a top view of the bubbled area where the aperture of the can will be.

FIG. 4 shows a cross section of the bubble 15 taken along line a—a of FIG. 3. The cross section has a curved portion with a minima in the center of the bubble. The shape and size of the bubble 15 is important because enough metal needs to be depressed in the right places for the next steps in the process to be carried out.

Figure 5:
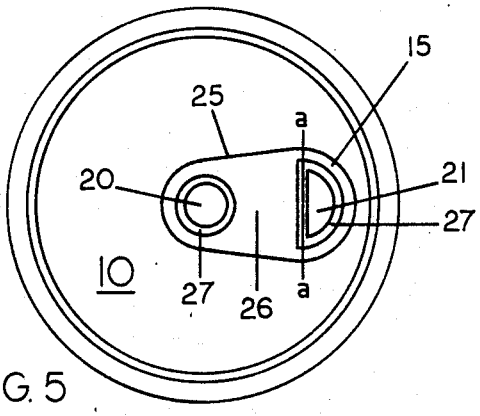
FIG. 5 shows a top view of the can end after the reforming step.

The next step in processing the can ends is to reform the bubbled area. FIG. 5 shows a top view of the can end after the bubbled area has been pressed in a die to reform the bubble 15. The reforming step leaves a generally flat surface 26 except for raising a circular vent button 20 and a semicircular tab button 21 in the metal. There is a sloping wall 27 between the surface 26 and the tops of vent button 20 and tab button 21. As will be shown later the vent button 20 will be used as a guide and aid in depressing the vent tab to open the can and the tab button 21 will be used as a guide and aid in depressing the main tab.

Figure 6:
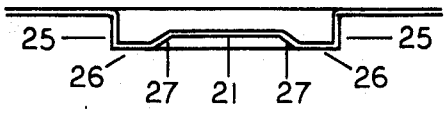
FIG. 6 shows a side view of the can end after the reforming step.

FIG. 6 shows a cross section of the reformed bubbled area 15 taken along line a—a of FIG. 5. This view shows the raised tab button 21 with its sloping wall 27. The reformed bubble has a side wall 25 perpendicular to the surface of the can end and extending around the perimeter of the bubbled area. The side wall 25 must be the right length to afford bending for the double fold score protection shown in a later step.

The reforming also leaves flat surface 26 on which scoring lines will be placed in the next step. Scoring the can end is a sensitive operation in that too deep a cut will sever the can end and too small a cut will make it difficult to open the can. Having the flat surface 26 makes it easier to score the can end. The score lines must not only be cut to the right depth but also be in the right place.

Figure 7:
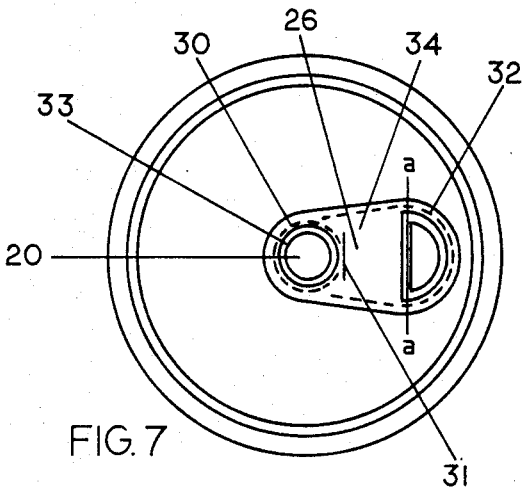
FIG. 7 shows a top view of the can end after scoring.

The next step in the process is to score the can end. FIG. 7 shows a top view of the can end with the score lines. The vent score line 30 is shaped as a section of a circle most of the way around the the vent button 20. There is a bend line 31 at one end of the vent score. The vent score line is to be broken by placing pressure on the vent button 30. The vent tab 33 is then pushed down. The score line tears most of the way around the circle of the vent tab until it gets to the bend line. The bend line 31 is a small ridge indented in the metal so that it will bend at that point but will not break. The bend line acts as a hinge for the vent tab. The vent tab 33 is defined by the borders of the vent score line and the bend line. The vent tab remains attached to the can end at the bend line.

The tab score line 32 begins near one side of the vent score line near the edge of the flat portion 26 and proceeds around the edge a fixed distance from side wall 25 to the other side of the tab ending near the other side of the vent score line.

The main tab 34 is defined by the borders of the tab score line 32.

There is a gap between where the tab score line 32 ends and the vent score line 30. The metal between these two score lines is used as a hinge. It is the bending point for the main tab and the means of attachment for the main tab to stay on the can end. The score lines must be far enough apart so the metal will not break between the two score lines and close enough so that the metal will bend easily so it can act as a hinge.

It is preferred to do the scoring in two steps using one die for the vent tab scoring and the bend line and another die for the main tab scoring, thus requiring two work stations for scoring.

Figure 8:
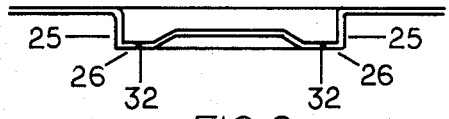
FIG. 8 shows a side view of the can end after scoring.

FIG. 8 shows a cross section of FIG. 7 taken along line a—a. Score line 32 is cut in the flat portion 26.

Figure 9:
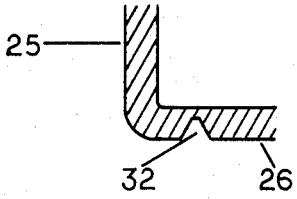
FIG. 9 shows a blow-up of the scoring.

FIG. 9 shows a blow-up of the score line 32 in the flat portion 26.

Figure 10:
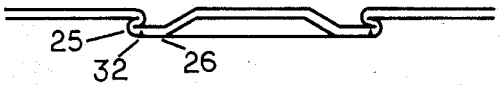
FIG. 10 shows a side view of the can end after folding.

FIG. 10 shows the next step in the process . The side wall 25 is folded over to form a triple layer of metal.

The score line is now recessed under the ridge created by the folds This is to protect the user. Any sharp edges created by tearing the score line are under the can end and recessed so that the users finger will not come in contact with the score line and get cut. Similarly the users tongue will not come in contact with the sharp edges and get cut if the user drinks from the can.

Another advantage of having the score lines recessed under the fold is that the tabs will not be pushed upward by the internal pressures of carbonated drinks.

In the folding operation the score line has been stressed and partly fractured. It is preferred to have the score lines cut such that the tips of the vent tab and the main tab have deeper cuts than the remainder of the score lines. The metal should be cut deep enough at the tips so that when the metal is folded it will fracture at the tips thus making the cans easier to open.

For these properties to be present it is necessary to use a metal with the quality of being able to be formed in this manner. Thre are several grades of steel that are preferred . The inventor has had success with the grade of steel 75 #TFS T4. Although certain grades of steel are preferred this method of forming can lids may be used with various grades of aluminum or other metals.

Figure 11:
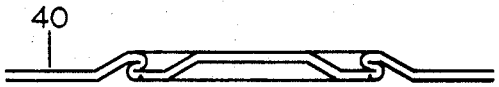
FIG. 11 shows a side view of the can end with the surface recessed.
Figure 12:
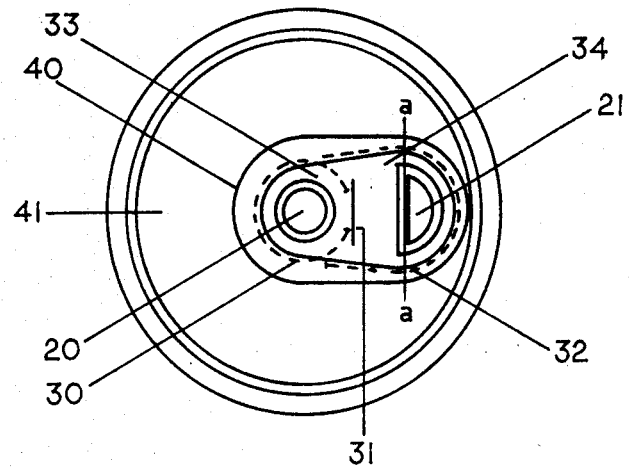
FIG. 12 shows a top view of a finished can end.

The next step in the process is to recess the area around the the tabs. FIG. 11 shows the recessed area 40 which is formed by depressing the metal next to the folded metal 25. This step may be combined with stenciling the can end at the same time. The finished can end is shown in FIG. 12 . The stenciling can be in the area marked by 41.

Recessing the metal in the area around the tabs 40 in effect raises the vent tab 33 and the main tab 34.

Figure 13:
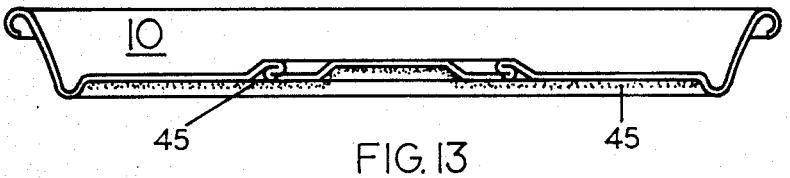
FIG. 13 shows a side view of a can end after it is sprayed with sealing compound.

The last step in the process is to spray a sealing material 45 on the bottom of the can end as shown in FIG. 13. The sealing material is to ensure that there is no leakage at the vent tab and main tab tips where the score line is fractured and for protection in case parts of the score line get fractured before the tabs are depressed . The sealing material also coats the metal of the can end so that the metal does not come in contact with the contents of the can.

Figure 14:
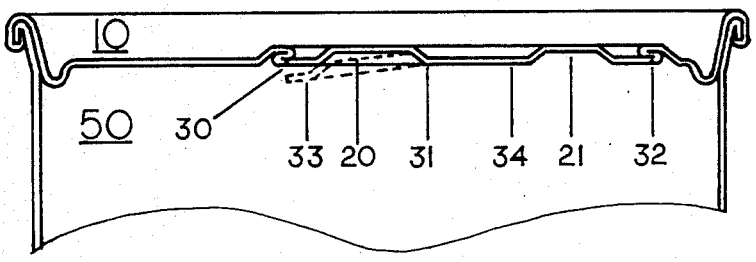
FIG. 14 shows a side view of the finished can with the vent tab depressed.
Figure 15:
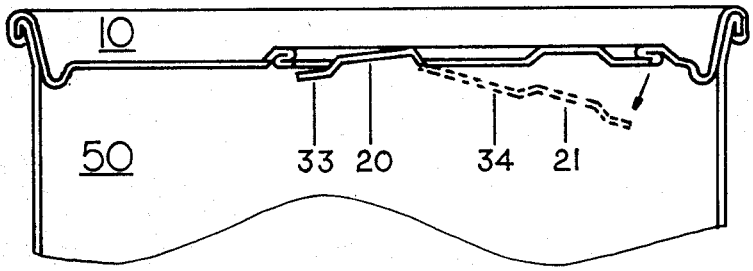
FIG. 15 shows a side view of the finished can with the main tab depressed.

FIGS. 14 and 15 show a side view of the can end 10 attached to a can 50. It shows how the tabs operate when pushed down. First the user presses down on the vent button 20, which tears the vent score line 30, depressing vent tab 33 into the can and releasing the pressure in the can. Then the user pushes down on the tab button 21 breaking the tab score line 32 and depressing main tab 34 into the can.

What is claimed is :

1. A method of manufacturing can ends having a push down vent tab and a push down main tab, with recessed socre lines under a double folded ridge of metal including the steps of:

a. depressing a bubble having a perimeter in a portion of a blank can end having a flat surface, b. reforming the bubbled area, in a die, to form a depressed flat surface parallel to the blank can end's flat surface and having a raised vent button having a perimeter, a raised tab button havinq a perimeter and a perpendicular side wall around the perimeter of the bubbled area, c. scoring a vent score most of the way around the perimeter of the vent button and forming a ridge in the can end to act as a bend line on the side of the vent button not scored, d. scoring a tab score partly around the perimeter of the tab button adjacent to the side wall and extending toward the vent tab, adjacent to the side wall, e. folding the side wall, in one die operation, so that the score lines are mostly under a ridge created by the fold, f. spraying a sealant material on the can end.

2. A method of manufacturing can ends having a push down vent tab and a push down main tab, with recessed score lines under a double folded ridge of metal as in claim 1 where there is an additional step of depressing an area around the vent tab and maian tab adjacent to the folded side

3. A method of manufacturing can ends having a push down vent tab and a push down main tab, with recessed score lines under a double folded ridge of metal as in claim 2 where there is an additional step of stenciling the can end.

4. A method of manufacturing can ends having a push down vent tab and a push down main tab, with recessed score lines under a double folded ridge of metal including the steps of:

a. depressing a bubble, having a perimeter, in a portion of a blank can end having a flat surface, a center and an edge, b. reforming the bubbled area, in a die, to form a depressed flat surface parallel to the blank can end's flat surface and having a circular raised vent button, having a perimeter, near the center of the can end, a raised semi circular tab button, having a perimeter, near the edge of the can end, and a perpendicular side wall around the perimeter of the bubbled area, c. scoring a vent score more than one half way around the perimeter of the vent button and placing a ridge in the can end to act as a bend line on the side of the vent button that is not scored, d. scoring a tab score around the semi circular part of the tab button adjacent to the side wall and extending along the side wall to a point near the score line around the vent button.

e. folding the side wall, in one die operation, so that the score lines are mostly under a ridge created by the fold, f. spraying a sealant material on the can end.

5. A method of manufacturing can ends having a push down vent tab and a push down main tab, with recessed score lines under a double folded ridge of metal as in claim 4 where there is an additional step of depressing an area around the vent tab and main tab adjacent to the folded side wall.

6. A method of manufacturing can ends having a push down vent tab and a push down main tab with recessed score lines under a double folded ridge of metal as in claim 5 where there is an additional step of stenciling the can end.

7. A method of manufacturing can ends having a push down vent tab and a push down main tab, with recessed score lines under a double folded ridge of metal as in claim 1 where the scoring around part of the vent button and around part of the tab button is cut deeper than the balance of the scoring so that when the side wall is folded a stress is placed on the scoring , fracturing the metal having the deeper scoring, thus making it easier to depress the tabs where the scoring is already broken, while opening the can.

8. A method of manufacturing can ends having a push down vent tab and a push down main tab, with recessed score lines under a double folded ridge of metal as in claim 7 where there is an additional step of depressing an area around the vent tab and main tab adjacent to the folded side wall.

9. A method of manufacturing can ends having a push down vent tab and a push down main tab, with recessed score lines under a double folded ridge of metal as in claim 8 where there is an additional step of stenciling the can end.

10. A method of manufacturing can ends having a push down vent tab and a push down main tab , with recessed score lines under a double folded ridge of metal as in claim 4 where the scoring around the semi circular part of the tab button and the scoring around part of the circle of the vent tab is cut deeper than the balance of the scoring so that when the side wall is folded a stress is placed on the scoring fracturing the metal having the deeper scoring, thus making it easier to depress the tabs where the scoring is already broken thus making it easier to open the can.

11. A method of manufacturing can ends having a push down vent tab and a push down main tab , with recessed score lines under a double folded ridge of metal as in claim 10 where there is an additional step of depressing an area around the vent tab and main tab adjacent to the folded side wall.

12. A method of manufacturing can ends having a push down vent tab and a push down main tab , with recessed score lines under a double folded ridge of metal as in claim 11 where there is an additional step of stenciling the can end.

* * * * *